United States Patent [19]

Tarlow et al.

[11] Patent Number: 4,828,532

[45] Date of Patent: May 9, 1989

[54] MOTORIZED COIL SPRING AMUSEMENT DEVICE

[75] Inventors: Kenneth A. Tarlow, Playa del Rey, Calif.; Brian Marguleas, 939 Melaleluca Ave., Apt. 1, Carlsbad, Calif. 92009

[73] Assignee: Brian Marguleas, Carlsbad, Calif.

[21] Appl. No.: 251,129

[22] Filed: Sep. 29, 1988

[51] Int. Cl.[4] ..... A63H 33/00

[52] U.S. Cl. ..... 446/486; 272/31 R; 40/411; 40/427

[58] Field of Search ..... 446/3, 486, 278, 487, 446/368, 322; 40/411, 414, 427; 272/31 R

[56] References Cited

U.S. PATENT DOCUMENTS

| | | | |
|---|---|---|---|
| 1,358,768 | 11/1920 | Maisano | 272/31 R |
| 1,566,479 | 12/1925 | Horvath et al. | 272/31 R |
| 2,061,695 | 11/1936 | Palton | 272/31 R |
| 2,325,988 | 8/1943 | Thomas | 446/322 X |
| 2,413,831 | 1/1947 | Jordan | 272/31 R |
| 2,415,012 | 1/1947 | James | 446/486 |
| 2,854,786 | 10/1958 | Sabo | 446/486 |
| 3,047,980 | 8/1962 | Bischoff | 446/486 |
| 4,114,306 | 9/1978 | Molenaar | 446/486 |

*Primary Examiner*—Robert A. Hafer
*Assistant Examiner*—Sam Rimell
*Attorney, Agent, or Firm*—Poms, Smith, Lande & Rose

[57] ABSTRACT

A motorized coil spring amusement device including a housing containing a motor with a track driven by the motor having dwell and flat portions on which a pair of spaced rollers roll. A vertical shaft extends from each roller up through the housing having a plate fixed to the top thereof. A flexible coil spring is fixed at each end of each of the plates. As the track is rotated, the rollers engage the dwell and flat portions raising the lowering the plates. This results in the coils of the coil spring moving back and forth between the plates. The rotation of the track can be timed to create a uniform transfer of the coils from one plate to the other.

15 Claims, 2 Drawing Sheets

MOTORIZED COIL SPRING AMUSEMENT DEVICE

BACKGROUND OF THE INVENTION

1. Field of the Invention

The invention relates to amusement devices; and, more particularly, to a motorized amusement device for transferring coils of a highly flexible coil spring from one side to the other in an amusing and entertaining manner.

2. Description of the Prior Art

Highly flexible coil spring toys have been known for many years. One such toy, and how it is made, is discussed in U.S. Pat. No. 2,415,012 to James. In this patent, the toy is placed on a flat platform and the platform is moved to allow the freely disposed toy to move up and down the board as the coils of the toy are transferred from one side to the other. In U.S. Pat. No. 3,047,980 to Bischoff, a similar coil spring toy has its end coil fixed to round plates which, when the platform on which the toy is freely disposed is moved, plates move from point to point on the platform. In U.S. Pat. No. 2,854,786 to Sabo, a complicated amusement device is disclosed wherein a coil spring toy has balls inside the coils which balls move back and forth from one end of the toy to the other as platforms fixed to the end coils are moved.

None of these prior art patents disclose an amusement device wherein the coils of such a helical coil toy move automatically from one relatively fixed point to another relatively fixed point until substantially all the coils are so moved, then repeat to return the transferred coils back to the other relatively fixed point. There is thus a need for an amusement device which can be operated to provide an amusing and intriguing display of the transfer of coils of a coil spring toy from one position to another.

SUMMARY OF THE INVENTION

It is an object of this invention to provide an amusement device wherein the coils of a flexible helical coil toy are automatically transferred from one side to another in a highly amusing and intriguing manner.

It is still further an object of this invention to provide such an amusement device wherein substantially all of the coils of the toy are transferred to one point, then back to another point.

It is another object of this invention to provide such an amusement device wherein the interior workings thereof are visible.

These and other objects are preferably accomplished by providing a motorized spring amusement device including a housing containing a motor with a track driven by the motor having dwell and flat portions on which a pair of spaced rollers roll. A vertical shaft extends from each roller up through the housing having a plate fixed to the top thereof. A flexible coil spring is fixed at each end to each of the plates. As the track is rotated, the rollers engage the dwell and flat portions raising and lowering the plates. This results in the coils of the coil spring moving back and forth between the plates. The rotation of the track can be timed to create a uniform transfer of the coils from one plate to the other.

DESCRIPTION OF THE PREFERRED EMBODIMENT

Figure 1:
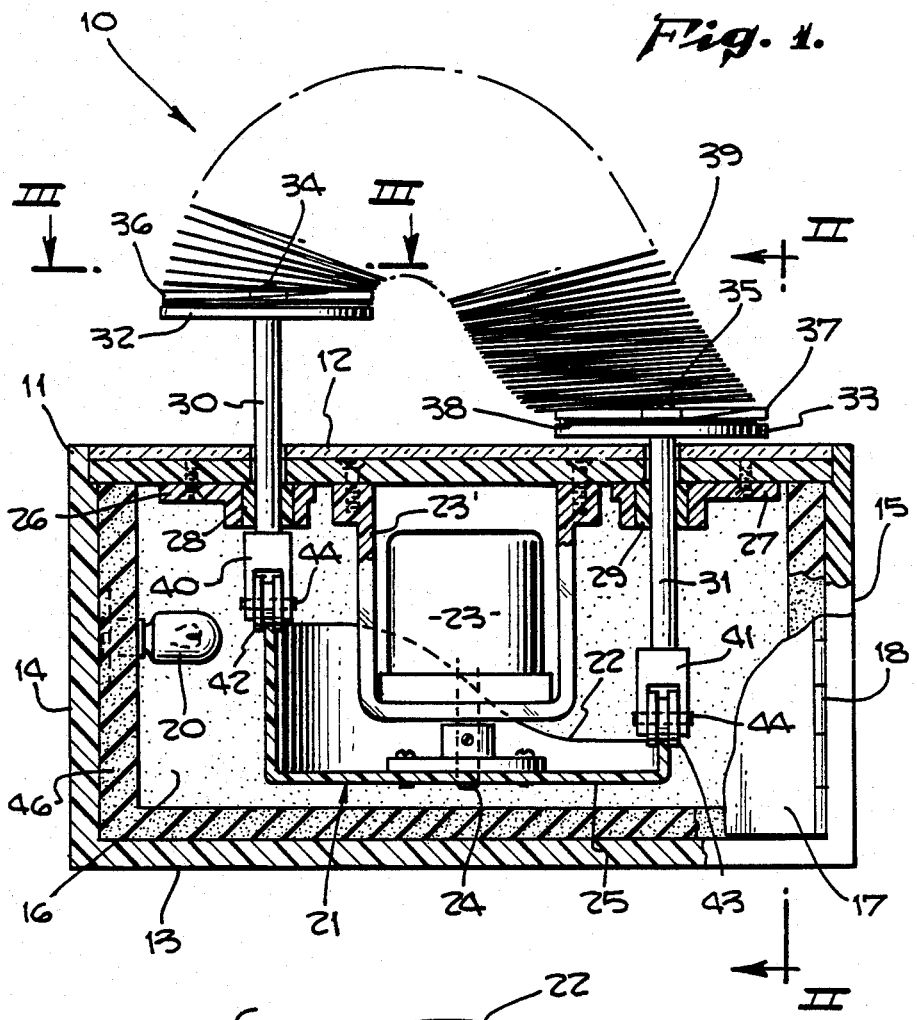
FIG. 1 is a vertical view, partly in section, of an amusement device in accordance with the teachings of the invention.
Figure 2:
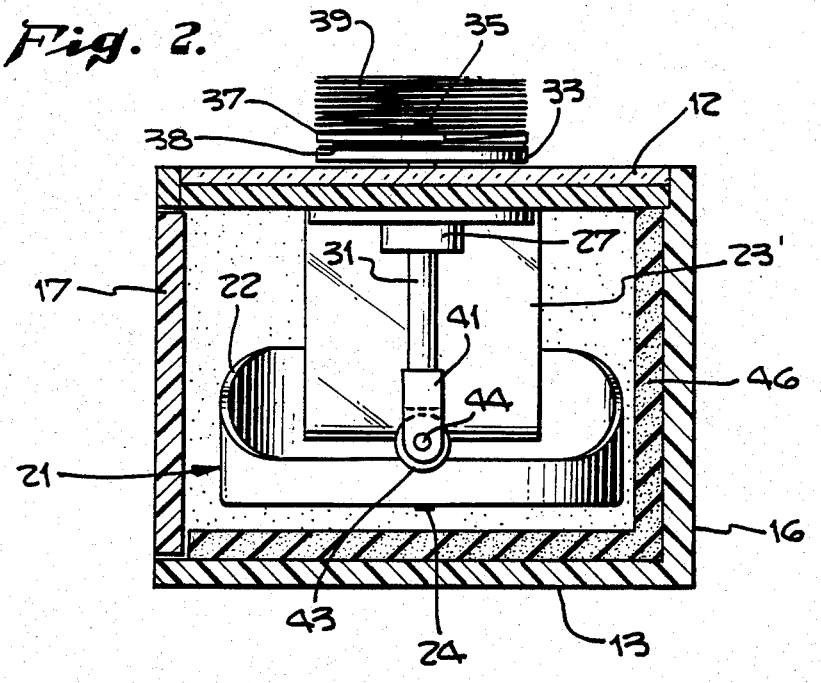
FIG. 2 is a view of a position of the device of Fig. 1, taken along lines II—II of FIG. 1.

Referring now to FIG. 1 of the drawing, an amusement device 10 is shown having a housing 11, which may be a rectangular box, with a top wall 12, a bottom wall 13, side wall 14, 15 and a rear wall 16 (see also FIG. 2). The entire housing 11 may be of any suitable material, such as plastic. Such material may be transparent or opaque. However, front wall 17 (FIG. 1) may be a door hinged at hinge 18 to side wall 15 and releasably locked thereto in any suitable manner. Thus, door 17 may be opened as desired for access to the inner workings of device 10, or to view the operator of the inner workings. Door 17 comprise a portion of the front wall of housing 11 or comprise the entire front wall and of any size to provide a door in the front wall (or on any other wall). Also, if desired, a light 20 may be provided, as seen in Fig. 1, operated by a switch or when the door 17 is opened to illuminate the interior of housing 11.

Figure 5:
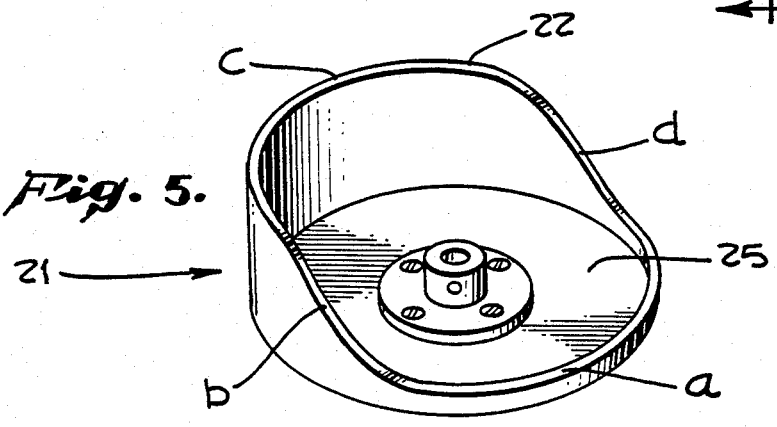
FIG. 5 is a perspective view of the carousel alone of FIGS. 1–4.

A rotatable carousel 21 (see also FIG. 5) is mounted interiorly of housing 11 on top of bottom wall 13. As seen in FIG. 5, carousel 21 is generally cylindrical having a track 22 provided at its upper edge. Carousel 21 is configured so that track 22 goes from a first low portion to a first high portion, then back down to a second low portion and back to a second high portion to return to the first low portion. This forms dwell areas at the flat areas of both low and high portions and ramps where the high portions merge into the low portions. As seen in FIG. 5, areas a and c may be the low and flat portions, respectively, with areas b and d the ramp portions. Each area a, b, c, and d may comprise about 25% of the entire periphery of track 22.

A motor 23 is provided having at least a major portion thereof visible when door 17 is opened, as seen in FIG. 1, and may have a transparent housing 23' for viewing the inner mechanisms thereof. Any suitable gear reduction motor may be used, such as the 120 volt, 60 HZ motor manufactured and sold by Brevel Co. Such a motor can be rotated at 29 revolutions per minute, the rate preferred for rotation of carousel 21. Motor shaft 24 is coupled to the bottom wall 25 of carousel 21 to rotate the carousel when motor 23 is actuated. Motor 23 may be battery operated, if desired, or have a suitable external power cord.

Figure 3:
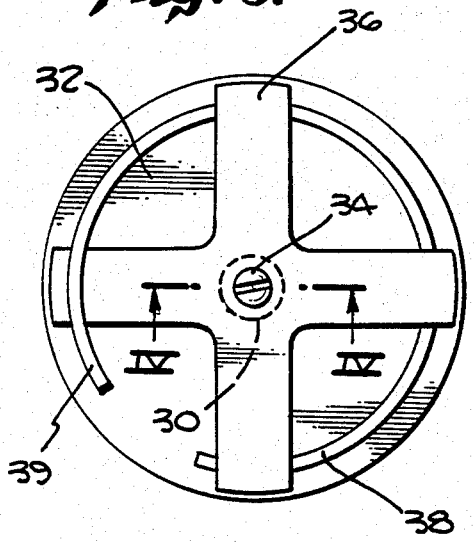
FIG. 3 is a view of the device of FIGS. 1 and 2 taken along lines III—III of FIG. 1.
Figure 4:
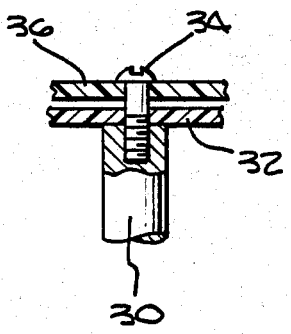
FIG. 4 is a view of a portion of the apparatus of FIGS. 1 and 2 taken along lines IV—IV of FIG. 3.

A pair of spaced bosses 26, 27 (FIG. 1) are provided on the underside of top wall 12 with bushings 28, 29, respectively, associated with each boss. Shafts 30, 31, respectively, extend through each bushing 28, 29. A pair of round flat plates 32, 33 are fixed to the upper end of each shaft 30, 31, respectively. This can be accomplished in any suitable manner. For example, as seen in FIG. 1, each shaft 30, 31 may have a screw 34, 35, respectively, extending through a hole in each plate 32, 33 (see also FIGS. 3 and 4) and threaded into the top of each shaft 30, 31. Each plate 32, 33 also has an X-shaped cross bar fixed thereto, such as bars 36, 37, respectively, screws 34, 35 also extending through suitable aligned holes in each bar 36, 37. As seen in FIG. 4, wherein one plate, such as plate 32, is shown, the spacing between the ends of bars 36, 37 is such that the end coil 38 of a highly flexible helical coil 39 is trapped between the bar 36 and plate 32. Similarly, the other end of coil 39 is trapped between bar 37 and plate 33 (FIG. 1).

Helical coil 39 is any suitable highly flexible helical coil such as the one disclosed in the aforementioned U.S. Pat. No. 2,415,012 to James. Such a coil is an endless coiled device terminating in round coil ends of very fine wire which can be easily trapped between the bars and plates as hereinabove disclosed. Of course, the coil 39 can be attached to the plates 32, 33 in any suitable manner.

Each shaft 30, 31 rides on track 22 as seen in FIG. 1. Thus, each shaft 30, 31 terminates at its lower end in a yoke 40, 41, respectively, having a roller 42, 43, respectively, journalled therein for rotation by means of axles 44, 45, respectively, journalled in the spaced downwardly extending spaced side walls of each yoke 40, 41 as seen in FIG. 1. Rollers 42, 43 may be of nylon and nylon may also be used for bosses 26, 27. Bushings 28, 29 may be of any suitable bushing material. Shafts 30, 31 may be metallic and carousel 21 may be of any suitable plastic material. Each shaft 30, 31 is of the same overall length and, thus, the spacing between the underside of each plate 32, 33 and top wall 12 varies as the carousel 21 rotates and the rollers 42, 43 rotate on the dwell and ramp portions of carousel 21.

Thus, in operation, motor 23 is actuated to rotate carousel 21. As the carousel 21 rotates, rollers 42, 43 roll on track 22 between the dwell and ramp portions a, b, c and d (see also FIG. 2). This moves plates 32, 33 up and down moving the coils of coil spring 39 back and forth from one plate to the other.

The upper surface of top wall 12 may be mirrored, if desired, at mirror 21', to provide a pleasing effect to the movement of the coils so the underside can be viewed. One complete revolution of carousel 21 results in one complete transfer of substantially all of the coils of coil spring 39 from one plate to the other. The rate of revolution of carousel 21 has been selected, and the proportions of track 22 selected, to provide ramp and dwell portions, to prevent coil spring 39 from attempting to go back or return to the transferror plate before substantially all coils are transferred from one plate to the other.

The maximum and minimum spacing between the bottom of plates 32, 33 and top wall 12 (or mirror 12') may be kept to about ½" to 2' to maintain the pleasing effect. The dwell and ramp portions of carousel 21 are thus chosen to be substantially of equal proportions to carry out the effect.

If desired, insulation, such as insulating foam insulation 46, FIG. 1, may be provided on all of the inner walls of housing 11 to eliminate or substantially reduce any noise from motor 23.

It can be seen that there is disclosed an amusement device that is both educational and highly entertaining. The coils of coil spring 39 move back and forth in a uniform manner, transferring substantially all coils in a single rotation of the carousel, before starting over. The inner workings can be observed at any time by opening door 17 or making housing 11 entirely transparent.

Although there is disclosed a particular embodiment of the invention, variations thereof may occur to an artisan and the invention herein is to be limited only by the appended claims.

We claim:

1. A motorized coil spring amusement device comprising:

a housing, said housing having at least a top wall;

a rotatable carousel mounted internally of said housing, said carousel having an upper peripheral endless track with ramp and dwell portions therealong;

a motor internally mounted in said housing coupled to said carousel for rotating the same;

a pair of vertical shafts extending upwardly through spaced apertures in the top wall of said housing, each of said shafts fixedly secured at its lower end to a rotatable wheel riding on the track of said carousel and having a plate fixed to the upper end thereof; and a flexible helical coil fixed at each end to each of said plates.

2. In the device of claim 1 wherein said track is irregularly configured having a low generally flat area and a high generally flat area with inclined ramps leading from each end of said low area to opposite ends of said high area, said low and high areas providing said dwell portions and said ramps providing said ramp portions, said ramps smoothly merging into said low and high flat areas.

3. In the device of claim 1 wherein each of said ramp portions comprise about 25% of the overall length of said track and each said low flat area and said high flat area comprise about 25% of the overall length of said track.

4. In the device of claim 1 wherein said top wall is mirrored on the outer surface thereof.

5. In the device of claim 1 wherein each of said plates is a flat round plate of a diameter generally related to the diameter of the coils of said coil.

6. In the device of claim 5 wherein the end coils of said coil are fixed to each respective plate.

7. In the device of claim 6 wherein a bar is fixed to the upper surface of each of said plates, said respective end coils being wedged between each said bar and its respective plate.

8. In the device of claim 1 wherein said housing has spaced side and end walls and a bottom wall forming an enclosed rectangle.

9. In the device of claim 8 wherein all of said walls are transparent.

10. In the device of claim 8 wherein all of said walls are opaque, one of said side walls having a means for opening so as to view the interior of said housing.

11. In the device of claim 1 wherein said motor is a gear reduction motor operating at 29 rpm.

12. In the device of claim 1 wherein said motor is mounted in a transparent motor housing so that its internal gears are visible.

13. In the device of claim including a light mounted interiorly of said housing.

14. In the device of claim 1 wherein the spacing between the bottom of said plates and the outer surface of said top wall is about ½" to 2".

15. In the device of claim 1 wherein said motor extends above said track.

* * * * *